US007284294B2

(12) United States Patent
Kozakow

(10) Patent No.: US 7,284,294 B2
(45) Date of Patent: Oct. 23, 2007

(54) DISPOSABLE LOW COST TOILET BOWL CLEANING IMPLEMENT

(76) Inventor: Andrew Kozakow, 536 W. Brompton, Unit 2S, Chicago, IL (US) 60657

( * ) Notice: Subject to any disclaimer, the term of this patent is extended or adjusted under 35 U.S.C. 154(b) by 25 days.

(21) Appl. No.: 10/803,327

(22) Filed: Mar. 18, 2004

(65) Prior Publication Data

US 2005/0204494 A1 Sep. 22, 2005

(51) Int. Cl.
*A47K 11/10* (2006.01)

(52) U.S. Cl. ..... 15/104.94; 15/209.1; 15/210.1; 15/223; 15/229.11; 15/229.13

(58) Field of Classification Search ..... 15/104.94, 15/209.1, 210.1, 223–225, 229.11, 229.13, 15/244.1, 143.1
See application file for complete search history.

(56) References Cited

U.S. PATENT DOCUMENTS 1,725,852 A * 8/1929 Cressler ..... 15/167.1
1,857,145 A * 5/1932 Funk ..... 604/1
2,190,427 A * 2/1940 John ..... 15/244.1
2,214,972 A * 9/1940 Ries ..... 15/244.1
2,265,274 A * 12/1941 Elliott ..... 15/104.94
2,346,782 A * 4/1944 Piluso ..... 300/21
2,595,776 A * 5/1952 Downey ..... 15/226
2,816,313 A * 12/1957 Gasper et al. ..... 15/210.1
4,244,075 A * 1/1981 Silver ..... 15/145
5,836,041 A * 11/1998 Kleinpell et al. ..... 15/236.02

FOREIGN PATENT DOCUMENTS

DE 2645188 * 4/1978
JP 11-42194 * 2/1999
JP 11-137496 * 5/1999

* cited by examiner

*Primary Examiner*—Mark Spisich
(74) *Attorney, Agent, or Firm*—Greenberg Traurig, LLP

(57) ABSTRACT

A disposable toilet bowl cleaning implement for discarding after one use, towards eliminating problems associated with the sanitary storage of toilet bowl cleaning products, the implement having a handle in the form of an elongated member with a reinforcement ridge extending along at least a substantial portion of the length of handle projecting in the direction transverse to the width of the handle. A scrubbing element is folded at least once upon itself to create a juxtaposed surface to surface contact over a substantial portion thereof to which the adhesive may be applied. A fastener further attaches the handle and the scrubbing element.

11 Claims, 3 Drawing Sheets

DISPOSABLE LOW COST TOILET BOWL CLEANING IMPLEMENT

BACKGROUND OF THE INVENTION

1. Field of the Invention

The present invention relates to cleaning bowl structures and more particularly pertains to a toilet bowl cleaning implement for cleaning all surfaces of a toilet bowl and the surrounding bathroom surfaces.

2. The Prior Art

The use of cleaning structures is known in the prior art. Many prior art patents relate expressly to the cleaning of toilet bowls. These include U.S. Design Pat. Nos. 176,156; 247,212 and 468,112; as well as U.S. Utility Pat. Nos. 4,493,124; 4,852,201; 5,203,155; 5,323,506; 5,488,728; and 5,941,379.

Heretofore, toilet bowl cleaning implements have typically consisted of a scrubbing element permanently mounted to a handled member. Rather than using commonly available materials for the scrubbing element in these typical devices, the scrubbing element has been especially designed for a particular toilet bowl cleaning implement. The prior art also discloses toilet bowl scrubbing implements having separate removable yet replaceable scrubbing elements. The replacement scrubbing elements are usually likewise designed for a specific toilet bowl cleaning implement. It also appears that a substantial amount of plastic is used to construct the handle, and in some cases, to also form the structure used for part of the scrubbing element. All of these factors add to the cost of the cleaning implement.

In addition, prior art toilet bowl cleaning implements are not disposable and thereby create a possible sanitation problem wherever the implement is stored. Often, a toilet bowl cleaning implement is stored in a storage cabinet within the bathroom where it may come in contact, or be in close contact, with other items such as toiletries, towels, medicines or cleaning materials, thereby causing the possible transfer of germs to those who use these articles. Whenever a non-disposable, non-one time use toilet bowl cleaning implement is stored in a cabinet or, for example, in a holder (which is commonly located adjacent to the toilet), germs may be transmitted to the toilet bowl and the surrounding areas.

Accordingly, it would be desirable to provide a toilet bowl cleaning implement that can be disposed of, in its entirety, after a single use, thereby eliminating the possibility of sanitation problems which may be caused by the storage and reuse of the prior art toilet bowl cleaning implement.

It would also be desirable to provide a toilet bowl scrubbing implement which is relatively stiff by folding a scrubbing element over onto itself, one which is relatively simple to use.

It would be further desirable to have a toilet bowl scrubbing implement which utilizes a minimum amount of plastic.

It would be still further desirable to have a toilet bowl scrubbing implement that utilizes commonly available materials for the scrubbing element, which are susceptible to a low manufacturing cost and which are accordingly susceptible to a low selling price to the consuming public, thereby making such a disposable toilet bowl cleaning implement economically available to the public and economically reasonable for complete disposability.

It would be yet further desirable to have a toilet bowl scrubbing implement that could be impregnated with a cleaning agent, scouring gel or powder or a deodorant.

These and other desirable characteristics of the present invention will become apparent in light of the present application, including the present specification, claims and drawings.

SUMMARY OF THE INVENTION

In view of the foregoing disadvantages inherent in the known types of toilet bowl cleaning structures now present in the prior art, the present invention provides a new toilet bowl cleaning implement construction that addresses the problems of sanitation and storage wherein the same can be utilized for cleaning a toilet bowl. As such, the general purpose of the present invention, which will be described subsequently in greater detail, is to provide a new toilet bowl cleaning implement which is both low in cost to manufacture and therefore low in cost to sell to the consuming public, and is also fully disposable. Such a toilet bowl cleaning implement has many of the advantages of the cleaning structures disclosed in the prior art and many novel features that result in a toilet bowl cleaning implement which is not anticipated, rendered obvious, suggested, or even implied by any of the prior art cleaning structures, either alone or in any combination thereof.

In the preferred embodiment, the toilet bowl cleaning implement has a handle configured as an elongated web, having a length, width and at least one reinforcement structure thereon, extending along at least a portion of the length of the handle and projecting transversely to the width thereof. The handle has a top and bottom surface and the reinforcement structure may comprise a flange that extends beyond the top and bottom surfaces of at least a portion of the length of the handle, about its periphery.

The invention further has a scrubbing element which can be readily fabricated from a sheet of conventional, readily available scrubbing material, which may also be made of an abrasive fibrous material, which sheet may be folded at least once and then attached to an end of the handle. While it is possible to fold the scrubbing material once, it may also be folded twice, or three times. The use of folds adds to the rigidity of the scrubbing element for its intended scrubbing function, under the rim of the toilet bowl. In addition, the scrubbing element may be impregnated with a cleaning agent, such as scouring gel or powder or a deodorant to add further effectiveness to the product.

Prior to folding, the scrubbing element may be of several shapes such as rectangular, square or round. Once the scrubbing element is folded into a preferred embodiment shape, an adhesive is applied along the juxtaposed surfaces. A fastener, such as a staple or rivet, is inserted through the folded material as well as the attachment region of the handle to affix the folded material to the handle.

DETAILED DESCRIPTION OF THE DRAWINGS

Figure 1:
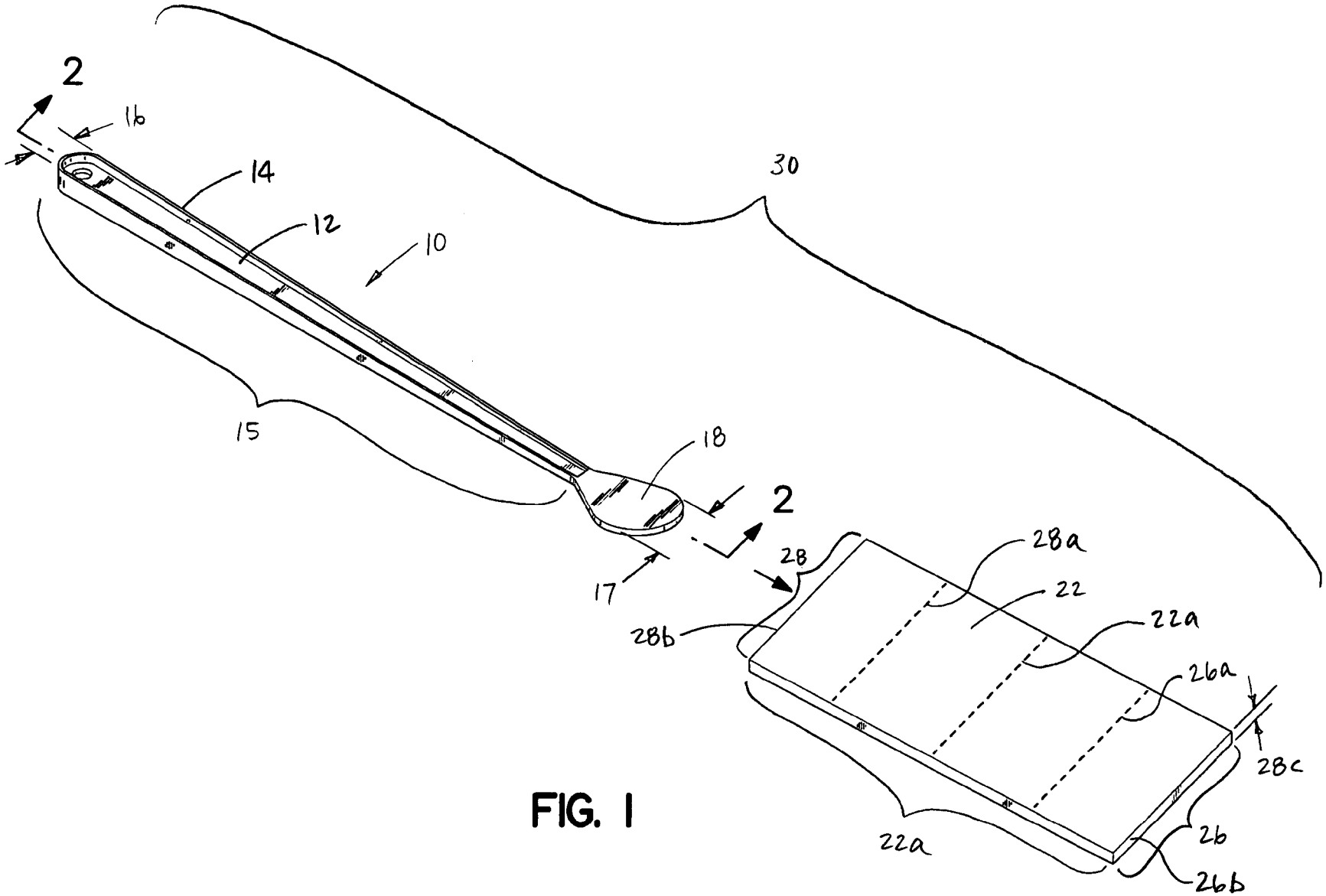
FIG. 1 is an exploded perspective view of a scrubbing pad and handle forming the toilet bowl cleaning implement of the present invention, prior to the articulation of the pad and assembly.
Figure 2:
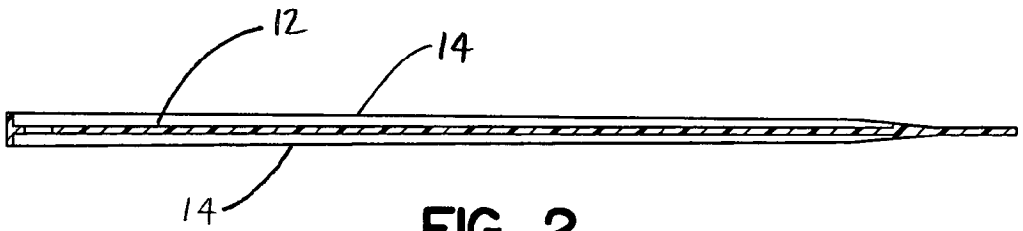
FIG. 2 is an elevated cross-sectional side view of the handle of FIG. 1, taken along lines 2-2 of FIG. 1 and looking in the direction of the arrows.

While this invention is susceptible of embodiment in many different forms, they are shown in the drawings and will herein be described in detail, one preferred embodiment, with the understanding that the present disclosure is to be considered as an exemplification of the principles of the invention and is not intended to limit the invention to the embodiment illustrated.

Figure 4:
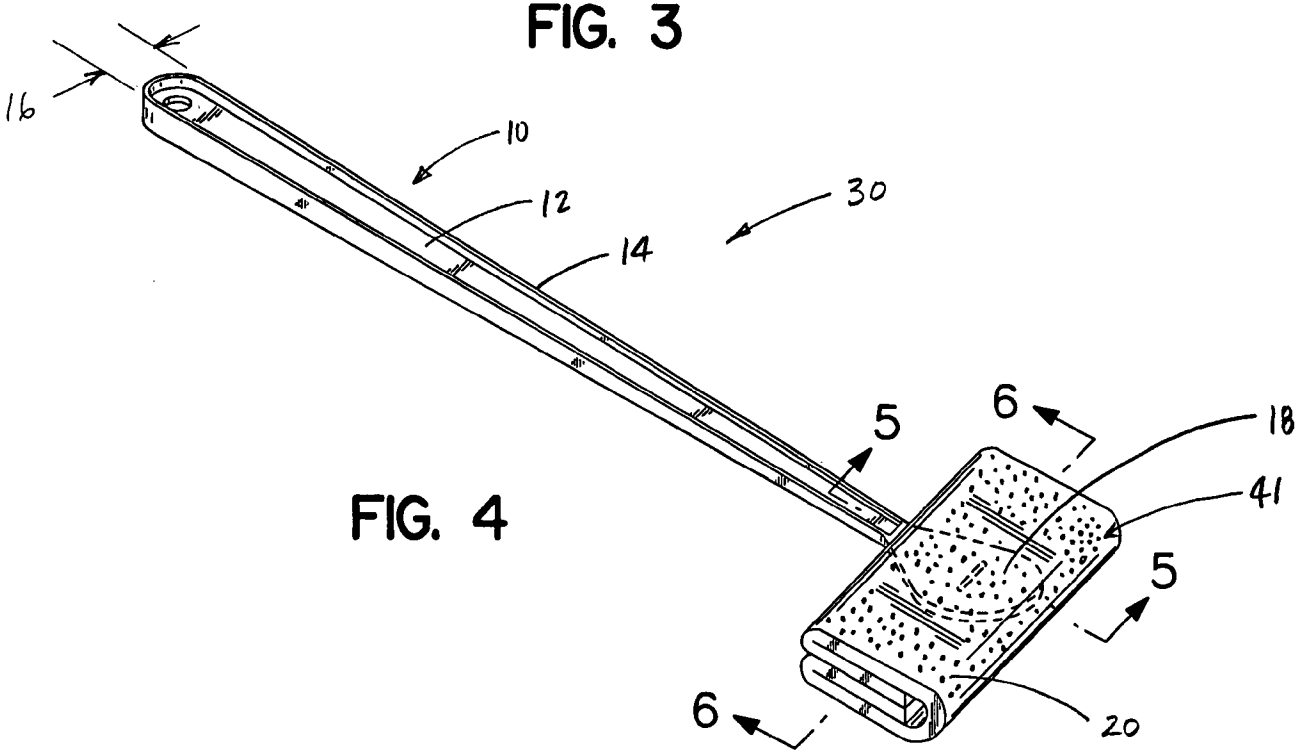
FIG. 4 is a perspective view of the scrubbing pad and handle of FIG. 3 fastened together.

As previously discussed, reusable toilet bowl cleaning implements are typically stored in a bathroom cabinet where they may come into contact with other items in the cabinet such as toiletries, towels, medicines or cleaning materials. Disposable low-cost toilet bowl cleaning implement 30 as illustrated in FIG. 4 addresses the problems of storage and sanitation of a reusable implement. As shown in exploded form in FIG. 1, the toilet bowl cleaning implement includes handle 10, having substantially flat portion 12 across the width and length of handle 10. The handle has first width 16 and second width 17, along attachment region or flange 18, which is substantially greater than first width 16. Structural reinforcement ridge 14, as illustrated in FIG. 1, is a peripheral edge surrounding flat portion 12 of handle 10, along most of the length 15 thereof, providing added rigidity to handle 10 and further providing for the use of a minimum amount of plastic used in connection with the manufacture of handle 10. Reinforcement ridge 14 is positioned about the periphery, and thus both sides of handle 10. As will be detailed below, the attachment region or flange 18 as illustrated, for example in FIG. 1, is provided for receiving the folded scrubbing element 20 as illustrated, for example, in FIG. 4. While in one preferred embodiment, the reinforcement ridge 14 extends along the perimeter of handle 10, a single centrally located ridge may extend on both the top and bottom surface of handle 10, extending for a substantial portion of the length of flat portion 12. Alternatively, both peripheral and centered reinforcement ridges may be integrated into the handle. Further, while the preferred embodiment contemplates the handle being constructed of a plastic material, the handle may also be made of other inexpensive materials such as wood.

As shown in FIG. 1, scrubbing material 22 of the disposable toilet bowl cleaning implement 30 prior to folding may be formed of a rectangular portion of a standard, commercially available abrasive scouring material. These scrubbing materials are commonly sold under the trademarks Brillo™ and/or Scotch-Brite™. In the illustrated embodiment, prior to folding, the scrubbing material of FIG. 1 may have a length 22*a* of approximately six inches and a width 26 of approximately four inches. The thickness 28*c* of the pad may be ⅜ of an inch. These dimensions are not intended to limit the scope of this invention but merely to be used as a representative example of the size of a typical scrubbing pad material. Indeed, it is contemplated that the unfolded material may not only be of a different size but also may be of a different shape, such as round, square or oval.

The use of a commonly available scrubbing material is another factor which contributes to the low-cost, disposable nature of this toilet bowl cleaning implement. As an alternative to using a commonly-available abrasive material, the material may be purchased in bulk and then die cut to an appropriate size and shape. Nor is the material used in this invention limited to a highly abrasive scrubbing material. Scrubbing materials, such as sponge or other commonly used materials for the cleaning of bathroom and kitchen surfaces, are also contemplated by this invention.

Figure 3:
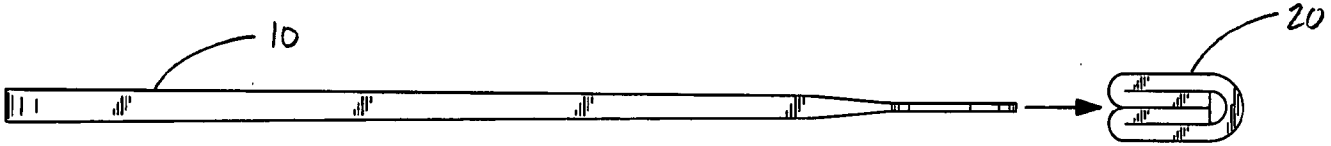
FIG. 3 is an exploded elevated side view of the unattached but folded scrubbing pad and handle.

In the preferred embodiment as illustrated in FIG. 1, ends 26*b* and 28*b* of rectangular material 22 are each first folded along lines 26*a* and 28*a* respectively, and then collectively folded again along line 22*a*. Fold lines 22*a*, 26*a* and 28*a* run across the entire width of material 22, each spaced in approximately one-fourth intervals of the length 22*a* of pad 22. When pad 22 is folded again at fold line 22*a*, it is done so in the same direction as the first two folds along folds 26*a* and 28*a*—to form fully articulated scrubbing element 20, as illustrated in FIGS. 3 and 4. The folds further define two juxtaposed lower surfaces at regions 20*a* and 20*b*, which are also in direct contact with each over a substantial portion, where the handle attachment region does not intervene, as shown in FIGS. 5 and 6, as well as juxtaposed upper surfaces 20*e* and 20*f* for opposite sides of attachment region 18.

As previously stated, the scrubbing material may be of many shapes, such as, rectangular (which is illustrated in this embodiment) as well as square, round or oval. Thus, the resulting scrubbing element is not limited to the rectangular shape, before or after articulation. In addition, the number of folds may also vary. The use of folds increases the rigidity of the scrubbing element to facilitate effective scrubbing under the rim of a toilet bowl.

Figure 5:
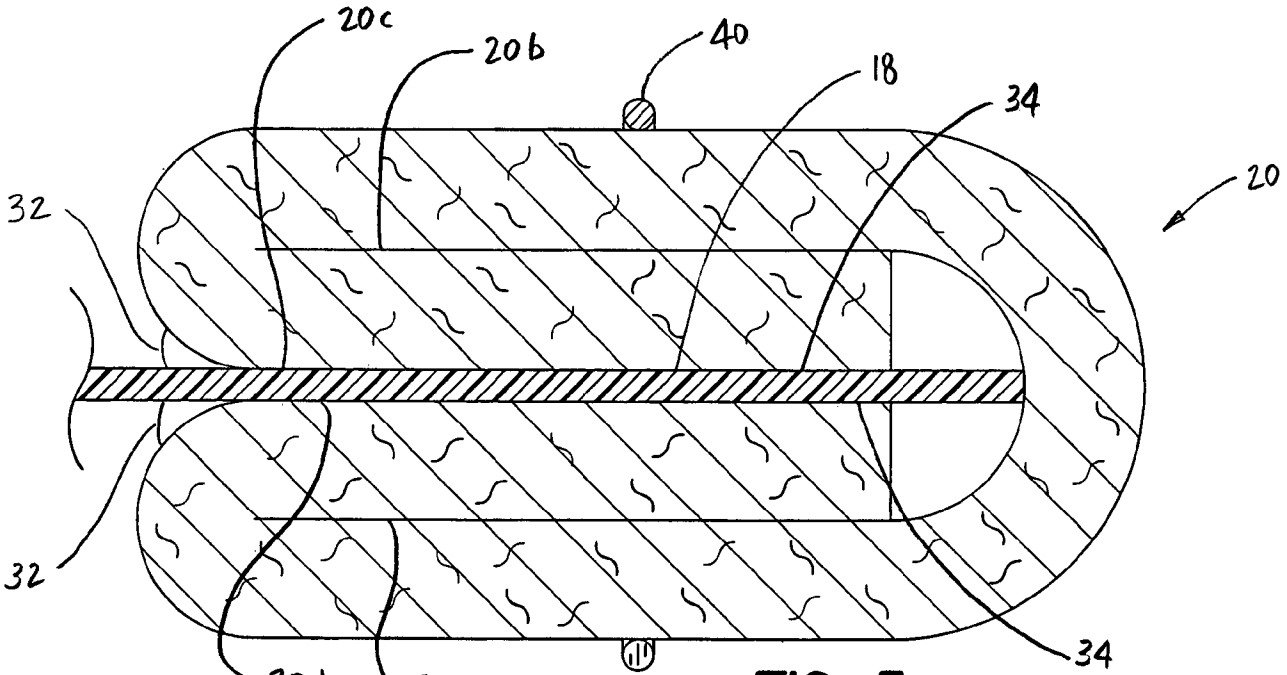
FIG. 5 is an elevated, cross-sectional side view of the folded scrubbing pad and handle fastened together, taken along lines 5-5 of FIG. 4 and looking in the directions of the arrows.
Figure 6:
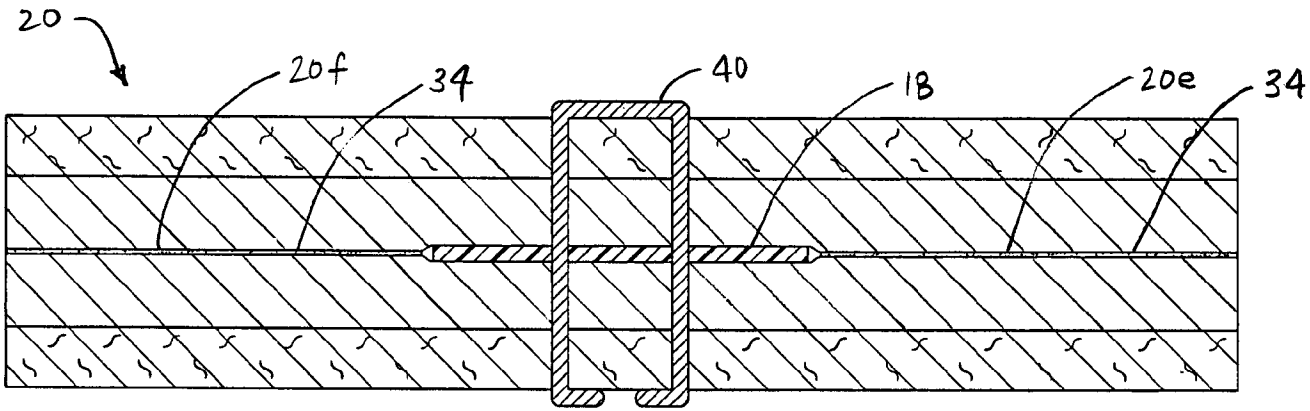
FIG. 6 is an elevated cross-sectional front view of the invention, taken along lines 6-6 of FIG. 4, and looking in the direction of the arrows, further illustrating the adhesive restraining the articulated pad together with a fastener further maintaining the position of the pad relative to the attachment region of the handle.

In the preferred embodiment, as best illustrated in FIGS. 5 and 6, adhesive 34 is applied along both the upper and lower surfaces of the length of scrubbing element 20, with the lower surface adhesive sealing the pad at positions 20*a* and 20*b* and with the adhesive on the upper surface of pad 20 sealing the pad at portions 20*c* and 20*d*, along attachment region 18, as well as along adjoining pad regions 20*e* and 20*f*, which are not separated by attachment region 18. Once the adhesive is applied, attachment region 18 of handle 10 is immediately inserted. Alternatively, adhesive may be applied over a substantial portion of both the juxtaposed surfaces and the handle itself, prior to insertion to reinforce restraint of the handle to the attachment region of the scrubbing pad. As shown in FIGS. 5 and 6, a fastener such as a staple 40 is applied, through scrubbing element 20 and either around or through flange or attachment region 18 of handle 10. As best illustrated in FIG. 4, it is also contemplated that a cleaning agent, such as scouring powder or gel, or a deodorizing agent, 41 is impregnated into scrubbing element 20 to improve the scrubbing effect of the implement.

There are several alternative ways to fold material 22. For example, pad material 22 may first be folded in half along line 22*a* and then folded again in half simultaneously along aligned fold lines 26*a* and 28*a*. Alternatively, material 22 may first be folded along line 26*a*, then along long line 22*a* and finally along line 28*a*. As described above, only one fold, (along fold line 22*a*) two folds (as described immediately above) or three folds, (two along 28*a* and 26*a* folded along the same surface, followed by a fold along fold line 22*a* to juxtapose the end quarters of pad 22 already folded) are required to articulate the pad. In any of these embodiments, adhesive is preferably applied to the juxtaposed surfaces of the folded pad.

In a preferred embodiment, attachment region 18 of handle 10 is substantially round and flat, and has a maximum diameter which is less than width 28 and 26 of folded scrubbing element 20. The shape of flange 18 of handle 10 is not limited to a round shape. Alternatively, flange 18 may be rectangular, oval or round as long as the size of the flange is less than the width of the folded scrubbing element. Of course, the use of a smaller flange, regardless of its shape, saves in the amount of plastic used in the manufacture of the handle, at the cost of stability for the pad.

As previously stated, it is contemplated in the shown preferred embodiment to use a low-cost staple 40 as illustrated in FIGS. 5 and 6 to ensnare and securely attach the folded scrubbing element 20 to flange 18 of handle 10. It is also possible to use a rivet or other fastener that is applied through folded scrubbing element 20 and handle 10. Furthermore, it is also contemplated by this invention to compress scrubbing element 20, which is positioned about handle 10, after applying adhesive 34 along the juxtaposed edge of attachment region 18 of handle 10.

The foregoing description and drawings merely explain and illustrate the invention and the invention is not limited, except insofar as the claims are so limited, as those skilled in the art who have the disclosure before them will be able to make modifications and variations therein without departing from the scope of the invention.

The invention claimed is:

1. A toilet bowl cleaning implement for disposal after a single use, said implement comprising:

a handle, configured as an elongated web, having a length describing a first end and a second opposite end, and a width, said handle having an upper and a lower surface;

an attachment region at one end of said handle;

a scrubbing element in the form of a sheet of scrubbing material that has been folded at least once along a straight fold line to increase the structural integrity of the implement;

said scrubbing element being permanently and restrainably attached about said first end of the handle by at least one element attachment member;

said scrubbing element being formed of a substantially rectangular sheet, having a first edge and an opposing second edge and a defined centerline, wherein the sheet is folded along a first fold line, disposed between the first edge and the centerline;

a second fold line, disposed between the second edge and the centerline of said sheet; and along a third fold line, oriented substantially at said centerline to juxtapose the upper surfaces of the sheet;

said first and second fold lines being oriented to juxtapose respective portions of the lower surfaces of the sheet, both said lower surfaces and said upper surfaces being further adhered to each other respectively by an adhesive applied therebetween, said handle and scrubbing element being configured for low-cost fabrication to enable the entire implement to be discarded after one use; and said at least one element attachment member including a staple through both said scrubbing element and said handle.

2. A toilet bowl cleaning implement, comprising:

a handle having a length and a first width and further including at least one reinforcement structure extending along at least a portion of the length of the handle and projecting in a direction transversely to the width of the handle, the handle further including an attachment region disposed at one end of the handle, the attachment region having a second width substantially greater than the first width, a scrubbing element having a substantially rectangular shape fabricated from a sheet of a scrubbing material, having a first edge and an opposing second edge, together with first and second fold lines, respectively disposed from the first and second edges, together with a third fold line at its centerline, to juxtapose portions of the upper surface of said sheet, said sheet being folded inwardly at said first and second fold lines and being further folded along said third fold line at said centerline to increase the structural integrity of the scrubbing element for scrubbing under the toilet bowl rim;

the scrubbing element being disposed on the end of the handle such that the attachment region is positioned between the two juxtaposed upper surfaces of said scrubbing element;

said handle and scrubbing element being configured for low-cost fabrication to enable the entire implement to be discarded after one use.

3. The toilet bowl cleaning implement according to claim 2 wherein the two juxtaposed upper surfaces are adhered to one another by an adhesive that is applied over a substantial portion of the juxtaposed inside surfaces.

4. The toilet bowl cleaning implement according to claim 2 wherein the scrubbing material is fibrous.

5. The toilet bowl cleaning implement of claim 4 wherein the scrubbing material is abrasive.

6. The toilet bowl cleaning implement according to claim 2 wherein the handle is made of plastic.

7. The toilet bowl cleaning implement according to claim 2 wherein the handle is made of wood.

8. The toilet bowl cleaning implement according to claim 2 where the handle has a "H"-shaped cross-sectional configuration over a substantial portion of its length.

9. The toilet bowl cleaning implement according to claim 2 further comprising at least one element attachment member inserted through the scrubbing element and the attachment region of the handle.

10. The toilet bowl cleaning implement according to claim 9 wherein the at least one element attachment member is a staple.

11. The toilet bowl cleaning element according to claim 2 wherein the scrubbing implement is impregnated with at least one of following: a cleaning agent, a scouring powder, a scouring gel, a deodorizing agent.

* * * * *